US006334333B1

(12) United States Patent
Shinhama

(10) Patent No.: US 6,334,333 B1
(45) Date of Patent: Jan. 1, 2002

(54) CONDENSER

(75) Inventor: Masayoshi Shinhama, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/537,509

(22) Filed: Mar. 29, 2000

(30) Foreign Application Priority Data

Mar. 30, 1999 (JP) ..... 11-88199
Feb. 25, 2000 (JP) ..... 12-49983

(51) Int. Cl.[7] ..... F25B 39/04
(52) U.S. Cl. ..... 62/509; 62/498; 165/176
(58) Field of Search ..... 62/506, 507, 509, 62/529, 530, 498; 165/110, 132, 176

(56) References Cited

U.S. PATENT DOCUMENTS

| | | | | | |
|---|---|---|---|---|---|
| 5,592,830 | A | | 1/1997 | Baba et al. | 62/509 |
| 5,709,106 | A | * | 1/1998 | Inaba et al. | 62/507 |
| 5,713,217 | A | | 2/1998 | Baba | 62/509 |
| 5,755,113 | A | | 5/1998 | Ferguson et al. | 62/474 |
| 5,884,503 | A | | 3/1999 | Inaba | 62/509 |
| 5,901,573 | A | * | 5/1999 | Kobayashi | 62/507 |
| 5,927,102 | A | * | 7/1999 | Matsuo et al. | 62/509 |
| 5,934,102 | A | * | 8/1999 | DeKeuster et al. | 62/509 |
| 5,946,938 | A | * | 9/1999 | Balthazard | 62/507 |
| 6,038,884 | A | * | 3/2000 | Dabrowski | 62/509 |
| 6,044,900 | A | * | 4/2000 | Kawahara | 165/110 |
| 6,158,503 | A | * | 12/2000 | Gille et al. | 165/132 |
| 6,182,744 | B1 | * | 2/2001 | Nakamura et al. | 62/509 |
| 6,209,348 | B1 | * | 4/2001 | Shinmura et al. | 62/509 |

FOREIGN PATENT DOCUMENTS

| | | |
|---|---|---|
| EP | 0 769 666 | 4/1997 |
| EP | 0 822 378 | 2/1998 |
| JP | 6-194005 | 7/1994 |
| JP | 8-35744 | 2/1996 |
| JP | 8-110125 | 4/1996 |
| JP | 9-257337 | 10/1997 |
| JP | 10-122705 | 5/1998 |

* cited by examiner

*Primary Examiner*—Teresa Walberg
*Assistant Examiner*—Fadi H. Dahbour
(74) *Attorney, Agent, or Firm*—Foley & Lardner

(57) ABSTRACT

A core section (10) of a condenser is formed such that a plurality of heat exchanging tubes (4), while being vertically arranged in multiple stages, are disposed between a pair of header pipes (2, 3). A reservoir tank (6) is joined to the header pipe (3). The header pipe (3) is communicatively connected to the reservoir tank (6) by a refrigerant passage of a connection member (40). The connection member (40) connects a portion of the header pipe (3) which is out of a joining portion of the header pipe (3) where it is joined to the reservoir tank (6) to a portion of the reservoir tank (6) which is out of a joining portion of the reservoir tank (6) where it is joined to the header pipe (3).

27 Claims, 8 Drawing Sheets

PRIOR ART

CONDENSER

BACKGROUND OF THE INVENTION

The present invention relates to a condenser used in a refrigeration cycle in a vehicular air conditioner, for example.

In some of the condensers used in the refrigeration cycle, a reservoir tank, i.e. an accumulator, for storing the refrigerant liquefied by cooling is provided for one of the paired header pipes, and is given the function of a liquid tank, as disclosed in JP-A-8-35744 and JP-A-8-110125.

FIG. 11 is an exploded, perspective view showing a major portion of a conventional product that is disclosed in JP-A-8-35744. In the product, a flat portion B1 with a flat surface B2 is formed on a header pipe B that is one of the paired header pipes, and a flat portion C1 with a flat surface C2 is formed also on a reservoir tank C. A through-hole B3 is formed in the flat portion B1 of the header pipe B at a predetermined location. A through-hole C3 having the same configuration as the through-hole B3 of the header pipe B is formed also in the flat portion C1 of the header pipe C at a predetermined location.

In the product, the through-hole B3 of the header pipe B is aligned with the through-hole C3 of the reservoir tank C, and the through-hole B3 of the header pipe B is joined to the through-hole C3 of the reservoir tank C by hard soldering, whereby the through-hole B3 and the through-hole C3 communicate the inside of the header pipe B with the inside of the reservoir tank C, and form a refrigerant passage D through which a refrigerant flows.

In the conventional product shown in FIG. 11, when the refrigerant leaks from a joining portion for forming the refrigerant passage D, the repair of the leakage requires hermetically sealing of the joining portion over its entire circumference by hard soldering, or the like. Since the refrigerant passage D is formed by joining together the flat surface B2 of the header pipe B and the flat surface C2 of the reservoir tank C, an area of the joining portion forming the refrigerant passage D is large, and the outer circumference of the joining portion is long.

Thus, when the refrigerant leaks from the joining portion forming the refrigerant passage D, much work is needed for its repair. In an extreme case, it is unavoidable to discard the condenser per se.

SUMMARY OF THE INVENTION

Accordingly, an object of the present invention is to provide a novel arrangement which enables easy work of repairing the refrigerant leakage from the joining portion forming the refrigerant passage when the leakage occurs.

To achieve the above-noted object, the present invention proposes the use of a connection member that is arranged to be attached to the reservoir tank and one of the heater pipes and to communicate the reservoir tank with the one of the header pipes.

A condenser according to the present invention preferably has the following arrangement:

Arrangement (1):

A plurality of heat exchanging tubes through which refrigerant flows are disposed between a pair of first and second header pipes and arranged in multiple stages to form a core section for cooling refrigerant through the heat exchanging tubes, a reservoir tank is joined to the first header pipe, and the first header pipe is communicated with the reservoir tank by a refrigerant passage. Further, the first header pipe is communicated with the reservoir tank by a connection member having the refrigerant passage, the connection member connects a portion of the first header pipe which is out of a joining portion of the header pipe where the header pipe is joined to the reservoir tank to a portion of the reservoir tank which is out of a joining portion of the reservoir tank where the reservoir tank is joined to the header pipe.

Arrangement (2):

In the arrangement (1), a separator for parting the core section into a condensing portion for condensing and liquefying a gaseous refrigerant and an overcooling portion for overcooling the liquid refrigerant thus formed by the condensing portion is provided within each of the header pipes, each the header pipe is parted, by the separator, into a first chamber communicating with the heat exchanging tubes of the condensing portion and a second chamber communicating with the heat exchanging tubes of the overcooling portion, and the connection member includes, as the refrigerant passage, a first refrigerant passage for communicatively connecting the first chamber in the first header pipe to the reservoir tank, and a second refrigerant passage for communicatively connecting the second chamber in the first header pipe to the reservoir tank.

Arrangement (3):

In the arrangement (2), the connection member includes a first connection member having the first refrigerant passage and a second connection member that has the second refrigerant passage and that is separated from the first connection member.

Arrangement (4):

In any one of the arrangements (1) to (3), an accessory connection port communicated with the refrigerant passage is provided on the connection member so that an accessory part can be attached to the accessory connection port.

Arrangement (5):

In the arrangement (4), a filter for filtering out dust contained in the refrigerant is inserted into and disposed in the refrigerant passage through the accessory connection port, and the accessory part serving also as a sealing plug of the accessory connection port is attached to the accessory connection port.

In the arrangement (1), the first header pipe is communicatively connected to the reservoir tank by a connection member provided with a refrigerant passage, the connection member connects a portion of the first header pipe which is out of a joining portion of the header pipe where it is joined to the reservoir tank to a portion of the reservoir tank which is out of a joining portion of the reservoir tank where it is joined to the header pipe. Accordingly, the joining portions for forming the refrigerant passage are a joining portion between the fist header pipe and the connection member and a joining portion between the reservoir tank and the connection member. Accordingly, the joining areas of the joining portions forming the refrigerant passages are smaller than that in the conventional product shown in FIG. 11 in which the refrigerant passage is formed by joining the first header pipe and the reservoir tank. Further, the length of the outer circumference of the joining portions forming the refrigerant passage is reduced.

When the leakage of the refrigerant from the joining portions forming the refrigerant passage occurs, the location of the leakage can be confined to either one of the joining portion between the first header pipe and the connection member and the joining portion between the reservoir tank and the connection member.

Accordingly, when the refrigerant leaks from the joining portions for forming the refrigerant passage, the circumferential length of the joining portion requiring its repair can be further shortened in comparison to that required in the conventional product shown in FIG. 11. Therefore, the repairing work to hermetically seal the joining portion over its entire circumference by hard soldering or the like is easy.

In the arrangement (2), the refrigerant liquefied by the condensing portion of the core section flows from the first chamber of the first header pipe into the reservoir tank, through the first refrigerant passage of the connection member. The liquid refrigerant in the reservoir tank flows from the tank through the second refrigerant passage of the connection member to the second chamber of the first header pipe, and flows into the overcooling portion where the refrigerant is overcooled. Therefore, even if the core section is parted into the condensing portion and the overcooling portion, the joining portions for forming the refrigerant passages are the joining portion between the first header pipe and the connection member and the joining portion between the reservoir tank and the connection member.

The areas of the joining portion for forming the refrigerant passages can be reduced when comparing with the conventional product shown in FIG. 11, and the circumference length of the joining portion can be reduced. When the refrigerant leaks from the joining portion for the refrigerant passage, the leaking location can be confined to the joining portion between the first header pipe and the connection member or the joining portion of the reservoir tank and the connection member.

Accordingly, even if the core section is parted into the condensing portion and the overcooling portion, when the refrigerant leaks from the joining portion for the refrigerant passage, the circumferential length of the joining portion requiring its repair is shorter than that in the conventional product shown in FIG. 11. As a result, the repairing work to hermetically seal the joining portion over its entire circumference by hard soldering or the like is easy.

In the arrangement (3), in the connection member, a first connection member with a first refrigerant passage is separate from a second connection member with a second refrigerant passage. A broad choice is secured in designing the layout of the first and second refrigerant passages, thereby increasing design freedom.

When the refrigerant leaks from the joining portions for forming both the refrigerant passages, the leaking location can be confined to the joining portion of one of the first connection member and the second connection member. Accordingly, the circumferential length of the joining portion requiring its repair is shorter than that in the arrangement (2). As a result, the repairing work to hermetically seal the joining portion over its entire circumference by hard soldering or the like is easy.

In the arrangement (4), an accessory connection port which communicates with the refrigerant passage and allows an accessory part to be attached thereto is provided on the connection member. Accordingly, accessory part such as a pressure switch, a pressure sensor, or a melting plug can be attached to the accessory connection port. Therefore, there is eliminated the work to set a mounting jig for the accessory part, such as a joint, in an intermediate portion of the refrigerant piping in the refrigeration cycle. This leads to reduction of the cost to construct the refrigeration cycle.

In the arrangement (5), a filter for filtering out dust contained in a refrigerant is inserted into and disposed in the refrigerant passage through the accessory connection port, and an accessory part serving also as a sealing plug of the accessory connection port is attached to the accessory connection port. Therefore, the sealing of the filter within the connection member and the attaching of the accessory part to the connection member can concurrently be carried out. The result is to improve the working efficiency in constructing the refrigeration cycle.

The present disclosure relates to the subject matter contained in Japanese patent application No. Hei. 11-88199 (filed on Mar. 30, 1999), and Japanese patent application No. 2000-49983 (filed on Feb. 25, 2000), which are expressly incorporated herein by reference in their entireties.

DESCRIPTION OF THE PREFERRED EMBODIMENT

First Embodiment

Figure 1:
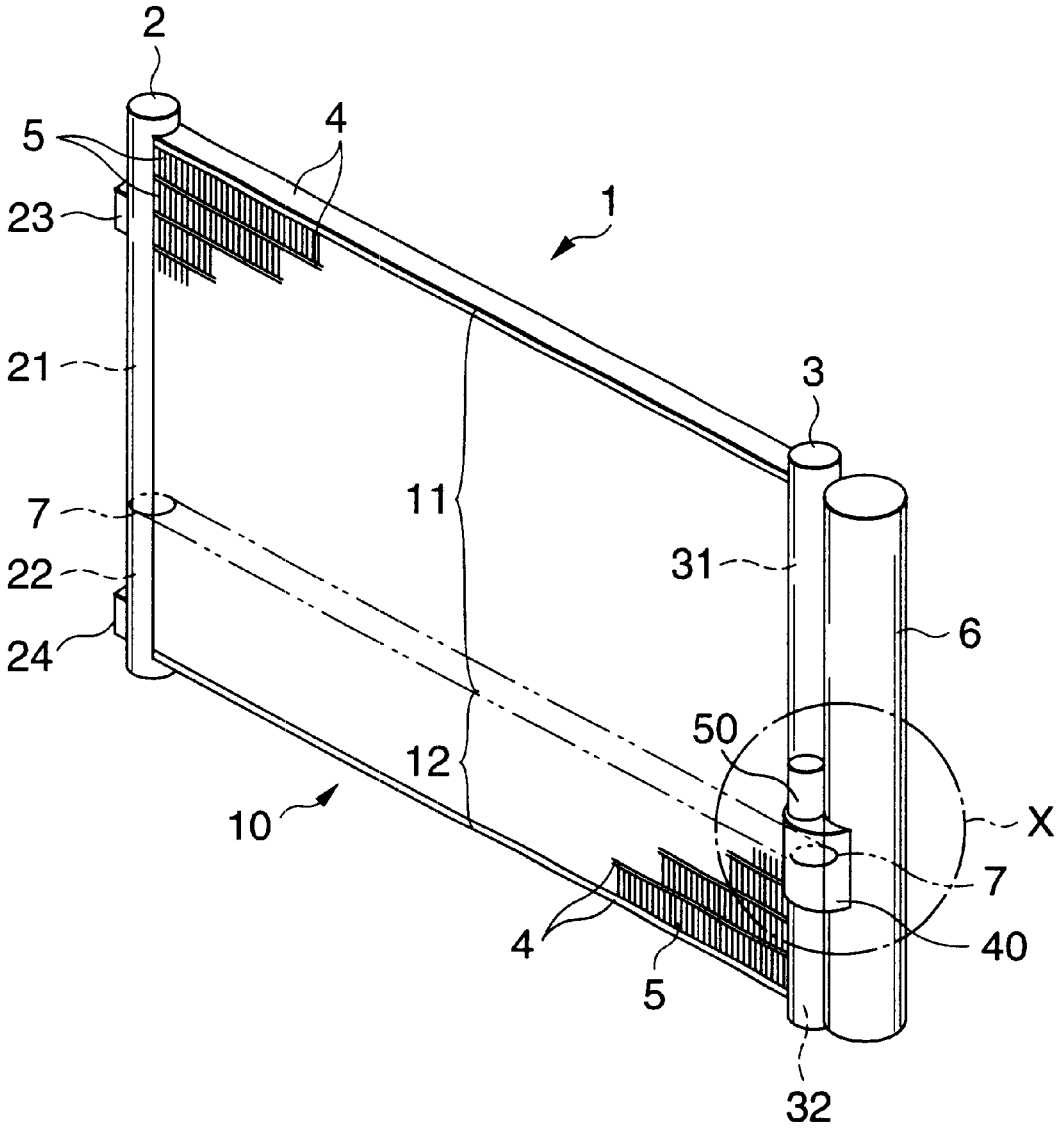
FIG. 1 is a perspective view showing an embodiment of the present invention.

FIG. 1 is a perspective view showing an embodiment according to the present invention, to which the arrangements (1), (2), (4) and (5) are applied. A condenser 1 is used in a refrigeration cycle of a vehicular air conditioner, and includes a pair of header pipes 2 and 3 of which the top and bottom ends are both closed. A plurality of flat, heat exchanging tubes 4 through which refrigerant flows are communicatively connected to both the header pipes 2 and 3 in a state that those heat exchanging tubes are disposed between those header pipes, while being vertically arranged in multiple stages.

Wavy radiation fins 5 are located between the adjacent heat exchanging tubes 4, while being in contact with those pipes disposed one on the other. The heat exchanging tubes 4 and the radiation fins 5 form a core section 10 which cools the refrigerant flowing through the heat exchanging tubes 4 by outside air flowing through spaces among the heat exchanging tubes 4.

A reservoir tank, i.e. an accumulator, 6 for reserving refrigerant liquefied by cooling is joined to the header pipe 3, and communicates with the header pipe 3 via a connection member 40. The connection member 40 connects a portion of the header pipe 3 which is out of a joining portion of the header pipe 3 where it is joined to the reservoir tank 6 to a portion of the reservoir tank 6 which is out of a joining portion of the reservoir tank 6 where it is joined to the header pipe 3.

A separator 7 for separating the core section 10 into a condensing portion 11 and an overcooling portion 12 is disposed within each of the header pipes 2 and 3. The condensing portion 11 liquefies, by cooling, a gaseous refrigerant into a liquid refrigerant, and the overcooling portion 12 overcools the liquid refrigerant, which liquefied by the condensing portion 11 and stored in the reservoir tank 6.

The inner space of the header pipe 2 is separated into a first chamber 21 communicating with the heat exchanging tubes 4 in the condensing portion 11 and a second chamber 22 communicating with the heat exchanging tubes 4 in the overcooling portion 12, by the separator 7 disposed within the header pipe 2. Similarly, the inner space of the header pipe 3 is separated into a first chamber 31 communicating with the heat exchanging tubes 4 in the condensing portion 11 and a second chamber 32 communicating with the heat exchanging tubes 4 in the overcooling portion 12, by the separator 7 disposed within the header pipe 2.

An inlet portion 23 with an inlet port, which introduces a gaseous refrigerant at high temperature and high pressure that is discharged from a compressor (not shown) into the first chamber 21 of the header pipe 2, is provided on the side surface of an upper part of the header pipe 2. An outlet portion 24 with an outlet port, which discharges the liquid refrigerant from the second chamber 22 of the header pipe 2 into an evaporator (not shown), is provided on the side surface of a lower pat of the header pipe 2.

The connection member 40 is disposed across the separator 7 on the header pipe 3. A pressure switch 50 is attached to the top end surface of the connection member 40. The pressure switch 50 is one of the accessory parts used in the refrigeration cycle, and it operates when a refrigerant pressure reaches a predetermined value, to generate a stop signal to stop the compressor (not shown).

Figure 2:
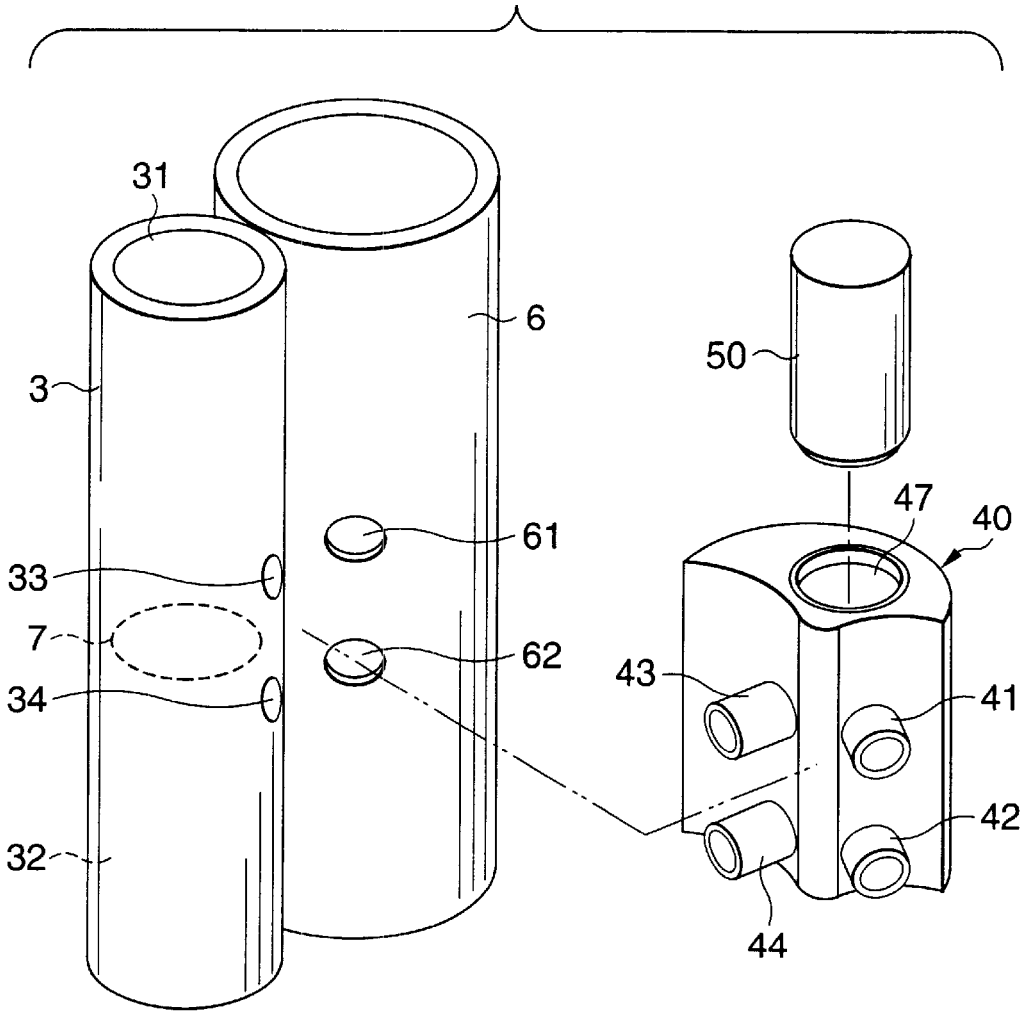
FIG. 2 is an exploded, perspective view showing a portion X in FIG. 1.
Figure 3:
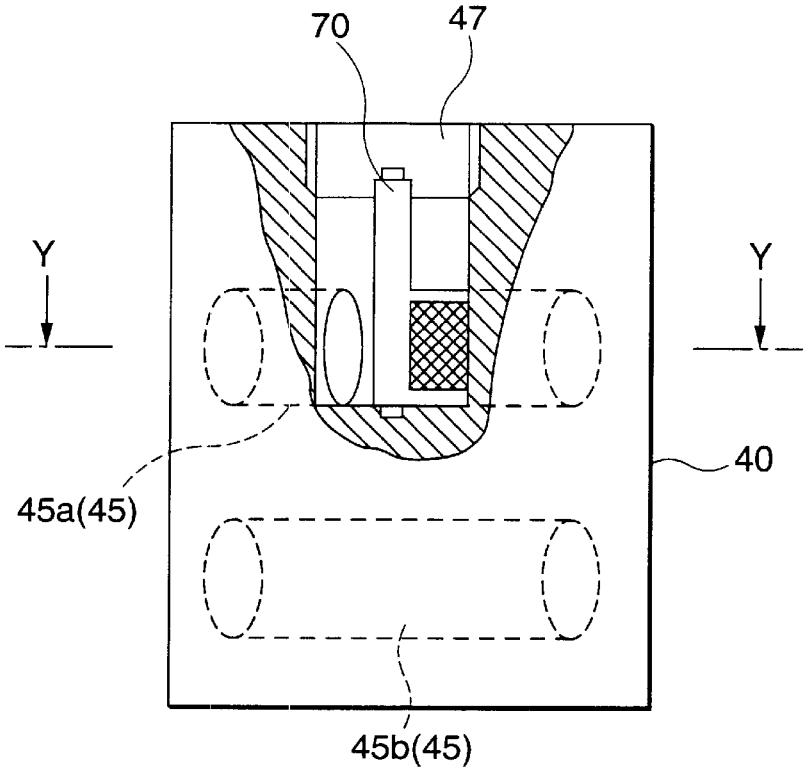
FIG. 3 is a fragmentary sectional view showing as connection member shown in FIG. 2.

FIG. 2 is an exploded, perspective view showing a portion X in FIG. 1. FIG. 3 is a fragmentary sectional view showing the connection member shown in FIG. 2. First and second pipe-like protruded portions 41 and 42 are provided on one of the side walls, arcuate in cross section, of the connection member 40, and third and fourth protruded portions 43 and 44 are provided on another side wall thereof.

The first protruded portion 41 communicates with the third protruded portion 43 in the connection member 40, and the second protruded portion 42 communicates with the fourth protruded portion 44 in the connection member 40. A partition wall is preferably provided within the connection member 40 to separate a passage extending from the first protruded portion 41 to the third protruded portion 43 from a passage extending from the second protruded portion 42 to the fourth protruded portion 44.

A first insertion hole 33 through which the first protruded portion 41 of the connection member 40 is inserted into the a first chamber 31 in the connection member 40 and a second insertion hole 34 through which the second protruded portion 42 of the connection member 40 is inserted into the second chamber 32 in the header pipe 3 are formed in the header pipe 3. A first insertion hole 61 through which the third protruded portion 43 of the connection member 40 is inserted into the reservoir tank 6 and a second insertion hole 62 through which the fourth protruded portion 44 of the connection member 40 is inserted into the reservoir tank 6 are formed in the reservoir tank 6.

The connection member 40 is joined to the header pipe 3 in a manner that the first protruded portion 41 is inserted into the first insertion hole 33, and the second protruded portion 42 is inserted into the second insertion hole 34 of the header pipe 3, and joined to the reservoir tank 6 in a manner that the third protruded portion 43 is inserted into the first insertion hole 61 of the reservoir tank 6, and the fourth protruded portion 44 is inserted into the second insertion hole 62 of the reservoir tank 6.

Accordingly, the connection member 40 includes refrigerant passage 45 by which the header pipe 3 communicates with the reservoir tank 6, to thereby allow a refrigerant to flow therethrough. That is, the connection member 40 includes, as the refrigerant passage 45, a first refrigerant passage 45*a* through which the first chamber 31 of the header pipe 3 communicates with the reservoir tank 6, and a second refrigerant passage 45*b* through which the second chamber 32 of the header pipe 3 communicates with the reservoir tank 6. The connection member 40 is formed with an accessory connection port 47 communicating with the first refrigerant passage 45*a*, and a pressure switch 50 is removably mounted to an opening of the accessory connection port 47.

Figure 4:
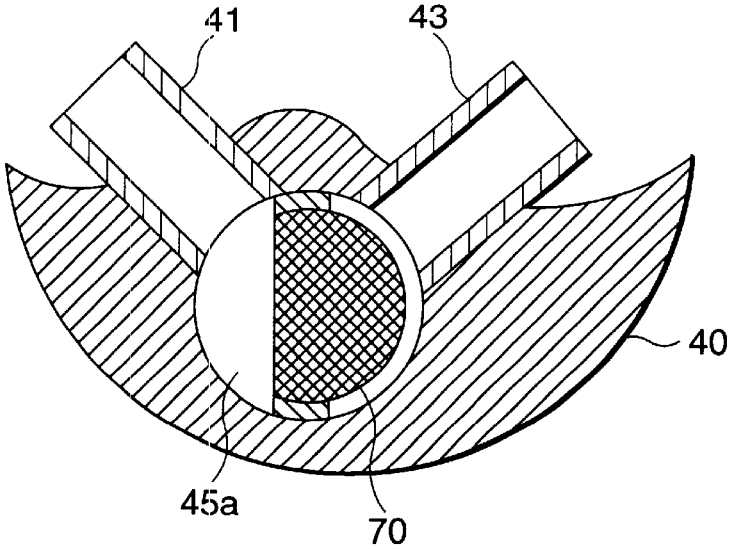
FIG. 4 is a cross sectional view taken on line Y—Y in FIG. 3.

FIG. 4 is a cross sectional view taken on line Y—Y in FIG. 3. As shown in FIGS. 3 and 4, a filter 70 for filtering off dust from the refrigerant is located in the first refrigerant passage 45*a* in a state that it maybe removed therefrom through an accessory connection port 47. The filter 70 is pushed by the pressure switch 50, thereby being fixed in place. The pressure switch 50 serves also as a sealing plug, and sealingly places the filter 70 within the connection member 40.

Figure 5:
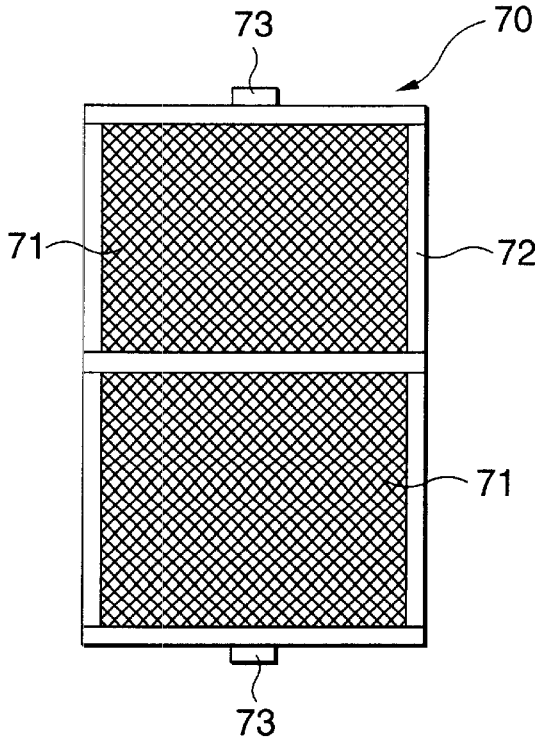
FIG. 5 is a front view showing a filter in FIG. 3.
Figure 6:
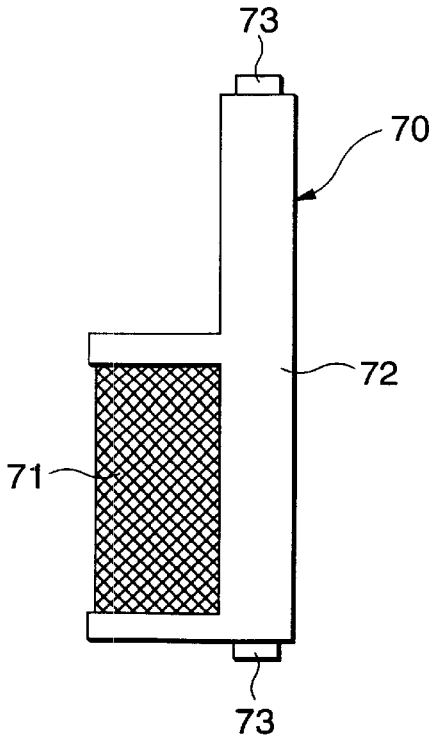
FIG. 6 is a right side view showing the filter of FIG. 5.
Figure 7:
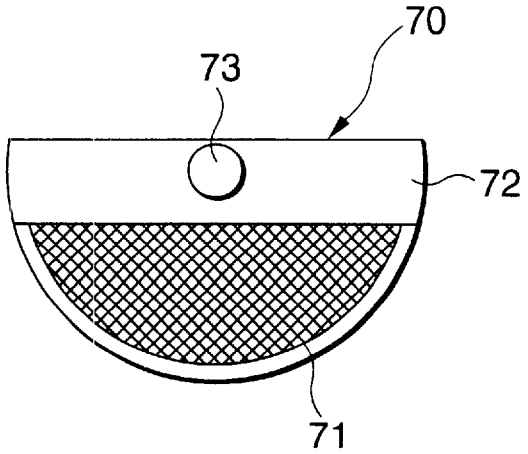
FIG. 7 is a plan view showing the filter of FIG. 5.

FIG. 5 is a front view showing the filter. FIG. 6 is a right side view showing the filter. FIG. 7 is a plan view showing the filter. As shown in FIGS. 5 through 7, the filter 70 is formed with a filter body 71 made of a mesh material, a frame 72 for holding the filter body 71, and positioning protrusions 73 protruded from the top and bottom surfaces of the frame 72.

The lower portion of the filter 70, which is disposed in the first refrigerant passage 45*a* of the connection member 40 is semicircular in cross section and an amount of mesh material in the lower portion is larger than that in the upper portion. The filter 70 is designed to reliably filter out dust contained in the refrigerant flowing through the first refrigerant passage 45*a* of the connection member 40.

The gaseous refrigerant flows from the inlet port of the inlet portion 23 into the first chamber 21 of the header pipe 2, and passes through the condensing portion 11 of the core section 10 where the refrigerant is cooled to be liquefied. The resultant liquid refrigerant reaches the first chamber 31 of the header pipe 3. The refrigerant which is derived from the first chamber 31 passes through the first refrigerant passage 45*a* of the connection member 40,and flows into the reservoir tank 6. At this time, the dust contained in the refrigerant is completely removed by the filter 70 located in the first refrigerant passage 45*a*.

The refrigerant having flowed into the reservoir tank 6 is separated into a gaseous refrigerant and a liquid refrigerant within the reservoir tank 6, and temporarily stored in the tank. The liquid refrigerant in the reservoir tank 6 flows therefrom through second refrigerant passage 45*b* of the connection member 40 to the second chamber 32 in the header pipe 3. The refrigerant output from the second chamber 32 flows through the overcooling portion 12 where the refrigerant is overcooled, and into the second chamber 22 of the header pipe 2. The refrigerant in the second chamber 22 flows out of the header pipe 2 through the outlet port of the outlet portion 24.

In the condenser 1, the header pipe 3 and the reservoir tank 6 are continuously connected to each other by the connection member 40 having the first and refrigerant passages 45*a* and 45*b*. The connection member 40 connects a portion of the header pipe 3 which is out of a joining portion of the header pipe 3 where it is joined to the reservoir tank 6 to a portion of the reservoir tank 6 which is out of a joining portion of the reservoir tank 6 where it is joined to the header pipe 3.

Accordingly, joining portions for forming the first and second refrigerant passages 45*a* and 45*b* are a joining portion between the header pipe 3 and the connection member 40 and a joining portion between the reservoir tank 6 and the connection member 40. On the other hand, in the conventional product shown in FIG. 11, the joining portion for forming the refrigerant passage D is the joining portion between the flat surface B2 of the header pipe B and the flat surface C2 of the reservoir tank C.

Figure 11:
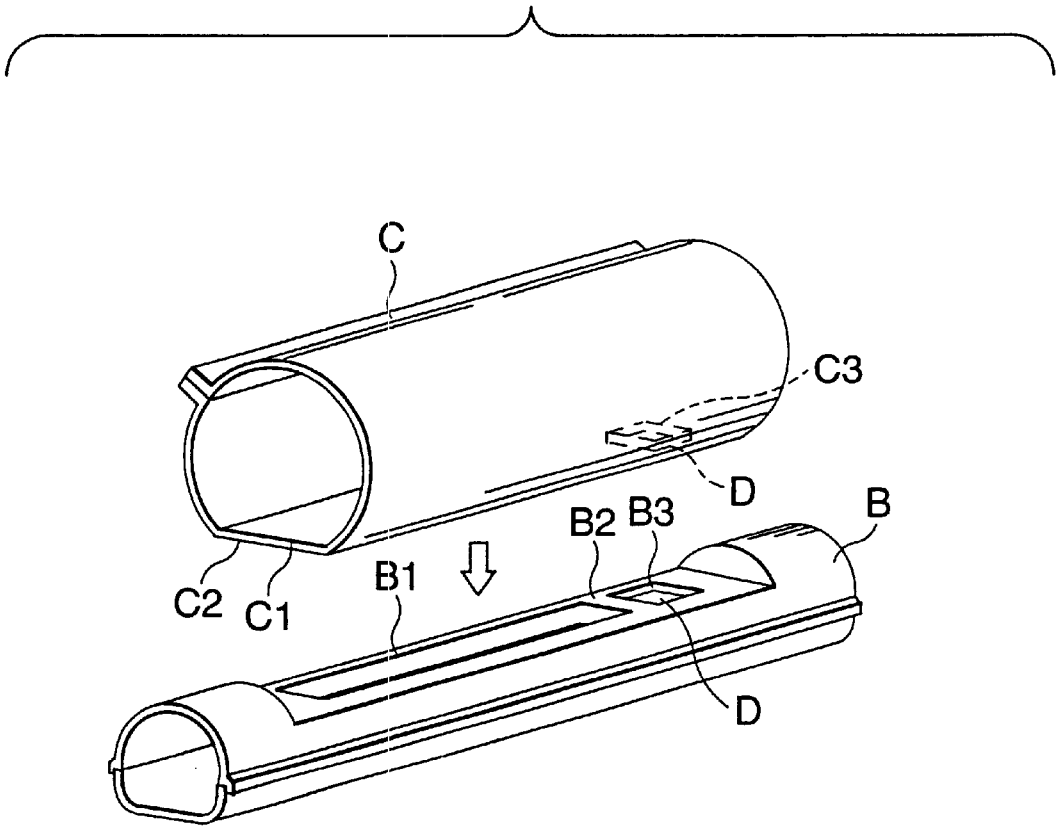
FIG. 11 is an exploded, perspective view showing a major portion of a conventional product.

Accordingly, in the condenser 11, the joining areas of the joining portions forming both the refrigerant passages 45*a* and 45*b* are smaller than that in the conventional product shown in FIG. 11, and the outer circumference of the joining portions is reduced in length. When the refrigerant leaks from the joining portions for forming the refrigerant passages 45*a* and 45*b*, a leaking location can be confined to either one of the joining portion between the header pipe 3 and the connection member 40 and the joining portion between the reservoir tank 6 and the connection member 40.

Accordingly, when, in the condenser 1, the refrigerant leaks from the joining portions for forming the refrigerant passages 45*a* and 45*b*, the circumferential length of the joining portion requiring its repair is shorter than that in the conventional product shown in FIG. 11. As a result, the repairing work to hermetically seal that joining portion over its entire circumference by hard soldering or the like is easy.

In the condenser 1, the accessory connection port 47 communicating with the first refrigerant passage 45*a* is provided in the connection member 40, and the pressure switch 50 is attached to the accessory connection port 47. Therefore, there is eliminated the work to set a mounting jig for the pressure switch 50, such as a joint, in an intermediate portion of the refrigerant piping in the refrigeration cycle. This leads to reduction of the cost to construct the refrigeration cycle.

In the condenser 1, the filter 70 for filtering out the dust contained in the refrigerant is inserted to the first refrigerant passage 45*a* of the connection member 40 through the accessory connection port 47 of the connection member 40, and the pressure switch 50 serving also as a sealing plug for the accessory connection port 47 is attached to the accessory connection port 47. Therefore, the sealing of the filter 70 within the connection member 40 and the attaching of the pressure switch 50 to the connection member 40 can concurrently be carried out. The result is to improve the working efficiency in constructing the refrigeration cycle.

The filter 70 is removably placed within the first refrigerant passage 45*a* of the connection member 40, through the accessory connection port 47 of the connection member 40. And the pressure switch 50 is detachably attached to the accessory connection port 47. Therefore, the washing and the exchanging work of the filter 70 is also easy.

Figure 9:
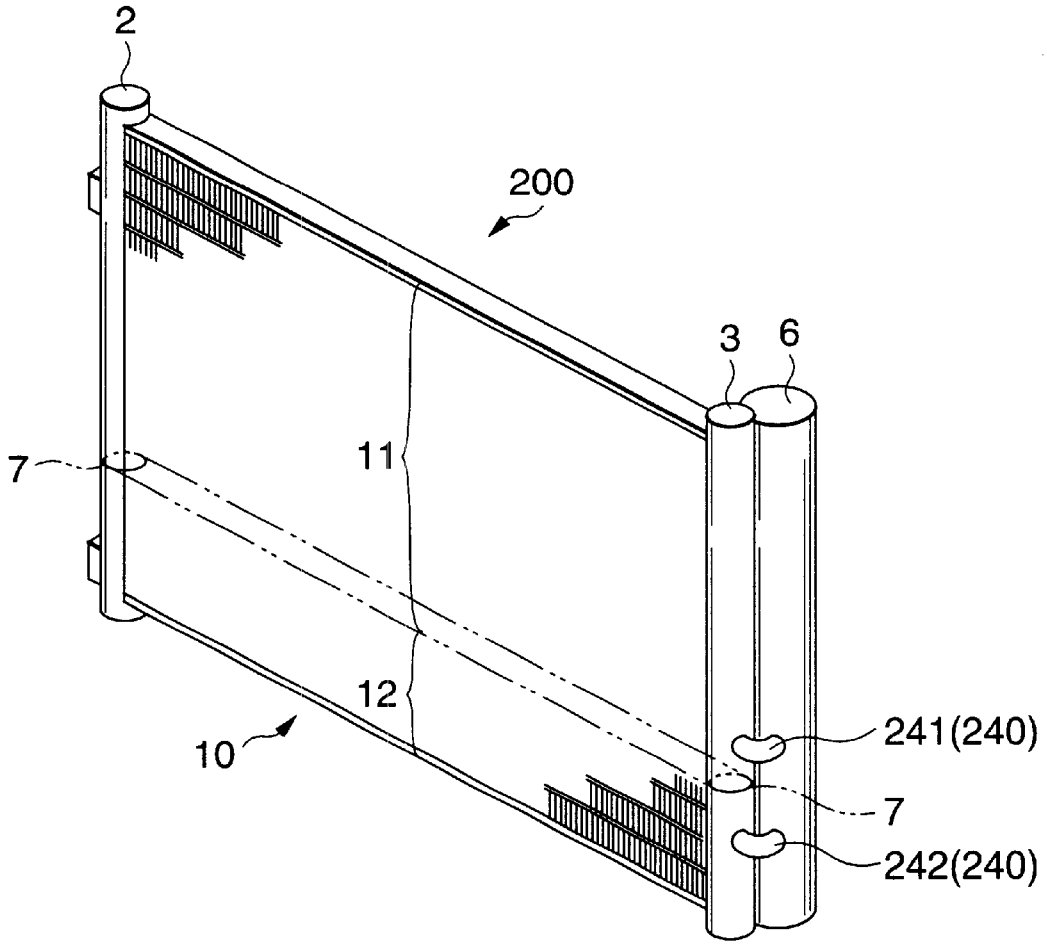
FIG. 9 is a perspective view showing yet another embodiment of the present invention.

Such a condenser is known in which a cover is removably provided on the reservoir tank, and a filter is removably placed in the reservoir tank in a sealing fashion (JP-A-7-180930, FIG. 9). In such a conventional condenser, the filter is placed in the reservoir tank, so that the inside space and the inside volume of the reservoir tank are reduced. This fact runs counter to the tendency of size reduction of the reservoir tank.

In this connection, in the condenser 1, the filter 70 is inserted into the first refrigerant passage 45*a* of the connection member 40 through the accessory connection port 47 of the connection member 40, and the pressure switch 50 serving also as a sealing plug for the accessory connection port 47 is attached to the accessory connection port 47. With this unique structure, there is no need of using the cover removably mounted on the reservoir tank 6 and the filter located therewithin. Accordingly, the size reduction of the reservoir tank 6 is realized.

Second Embodiment

Figure 8:
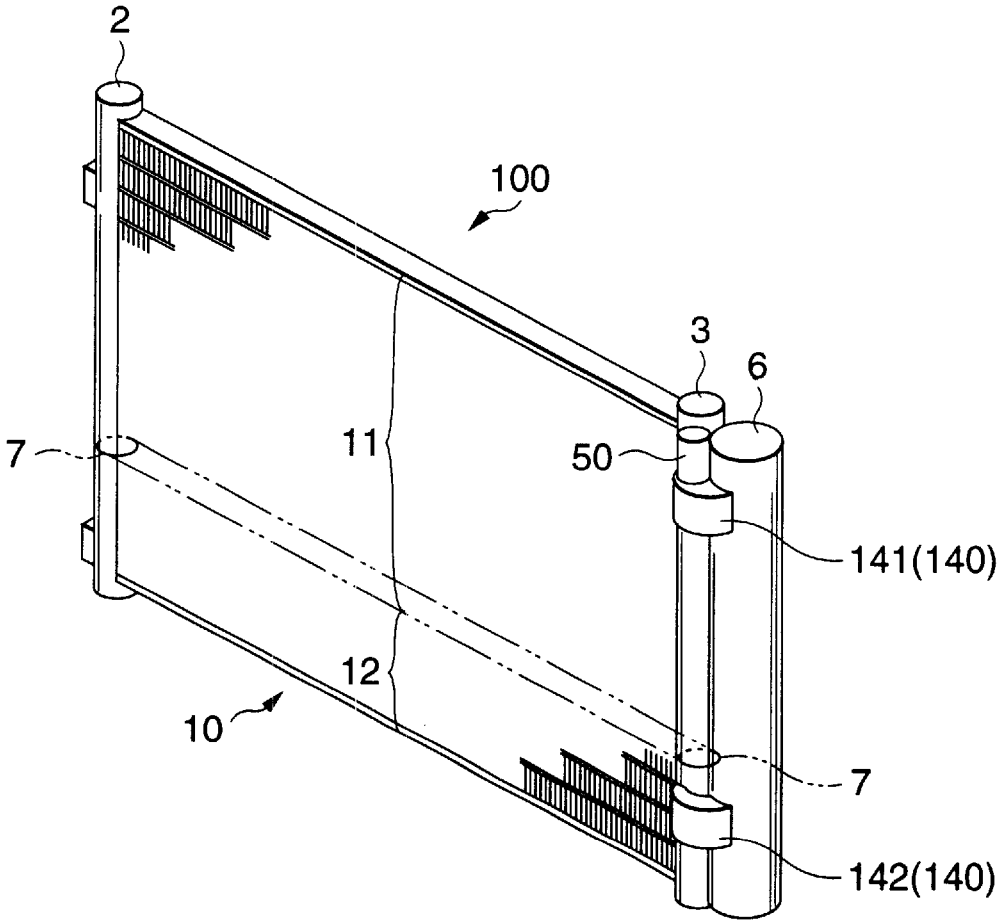
FIG. 8 is a perspective view showing another embodiment of the present invention.

FIG. 8 is a perspective view showing an embodiment of the invention, to which the arrangement (1) to (5) are applied. In the description of the second embodiment, like or equivalent portions are designated by like reference numerals.

In a condenser 100 shown in FIG. 8, the connection member 140 includes a first connection member 141 with a first refrigerant passage 45*a* and a second connection member 142 with a second refrigerant passage 45*b*, which is provided separately from the first connection member 141. The first connection member 141 is disposed in the upper portions of the header pipe 3 and the reservoir tank 6, and the pressure switch 50 is detachably attached to the top end surface of the first connection member in which the accessory connection port 47 is formed.

In the condenser 100, the first connection member 141 with the first refrigerant passage 45*a* is separate from the second connection member 142 with the second refrigerant passage 45*b*. Therefore, a broad choice is secured in designing the layout of the first and second refrigerant passages 45*a* and 45*b*, thereby increasing design freedom.

When the refrigerant leaks from the joining portions for forming the refrigerant passage 45, a leaking location can be confined to one of the joining portions of the first connection member 141 and the second connection member 142. The circumferential length of the joining portion requiring its repair is shorter than that in the condenser 1. As a result, the repairing work to hermetically seal that joining portion over its entire circumference by hard soldering, for example, is easy.

Since the first connection member 141 is disposed in the upper portions of the header pipe 3 and the reservoir tank 6, the attaching and detaching of the pressure switch 50 to and from the top end surface of the first connection member 141 is easy.

In the condenser 1, 100 mentioned above, the pressure switch 50 is attached to the top end surface of the connection member 40, 140. In an alternative, the accessory connection port 47 of the connection member 40, 140 may be formed through a proper surface, other than the top end surface, of the connection member 40, 140, and the pressure switch 50 maybe attached to this surface opened for the accessory connection port.

The condenser 1, 100 uses the pressure switch 50 as the accessory part used in the refrigeration cycle. However, the accessory part is not limited to the pressure switch 50, but may be a pressure sensor for sensing a pressure of the refrigerant, a melting plug which will melt when a temperature of the refrigerant reaches a predetermined value, or the like.

Further, in the condenser 1, 100, the connection member 40, 140 is provided with the accessory connection port 47 communicating with the first refrigerant passage 45*a*. In an alternative, the connection member 40 (140) may be provided with the accessory connection port 47 communicating with the first refrigerant passage 45*a* and another accessory connection port communicating with the second refrigerant passage 45*b* or may be provided with only the latter in place of the accessory connection port 47.

The filter 70 may be inserted into and disposed in the second refrigerant passage 45*b*, through the accessory connection port communicating with the second refrigerant passage 45*b*, as a matter of course. Further, the filter 70 may be removably disposed in at least one of the first and second refrigerant passages 45*a* and 45*b*.

In a case where a desiccant, e.g., silica gel, for removing water content of the refrigerant, while being held with a mesh material having a permeability to liquid, is located in the reservoir tank 6, there is the possibility that broken pieces of the desiccant flows, together with the refrigerant, out of the reservoir tank 6, and the heat exchanging tubes 4 are clogged with those broken pieces. However, this problem can be solved by locating the filter 70 in the second refrigerant passage 45*b*.

Third Embodiment

FIG. 9 is a perspective view showing an embodiment of the present invention, to which the arrangements (1) to (3) are applied. In the description of the third embodiment, like or equivalent portions are designated by like reference numerals.

In a condenser 200 shown in FIG. 9, a connection member 240 includes a first connection member 241 with a first refrigerant passage 45*a* and a second connection member 242 with a second refrigerant passage 45*b*, which is separate from the first connection member 241. Each of the first and second connection members 241 and 242 is formed as a pipe member, and the accessory connection port 47 is not provided to each of the first and second connection members 241 and 242.

In the condenser 200, the first and second connection members 241 and 242 are both formed as pipe members without the accessory connection port 47. Therefore, both the connection members 241 and 242 are simple in structure, and hence weight of and cost to manufacture those members are reduced.

In the condenser 1, 100, 200, the core section 10 is parted into the condensing portion 11 and the overcooling portion 12 by the separator 7, and the header pipe 3 is parted into the first chamber 31 and second chamber 32 by the separator. Accordingly, the connection member 40, 140, 240 must include, as the refrigerant passage 40, at least two passages, the first refrigerant passage 45*a* and the second refrigerant passage 45*b*.

Figure 10:
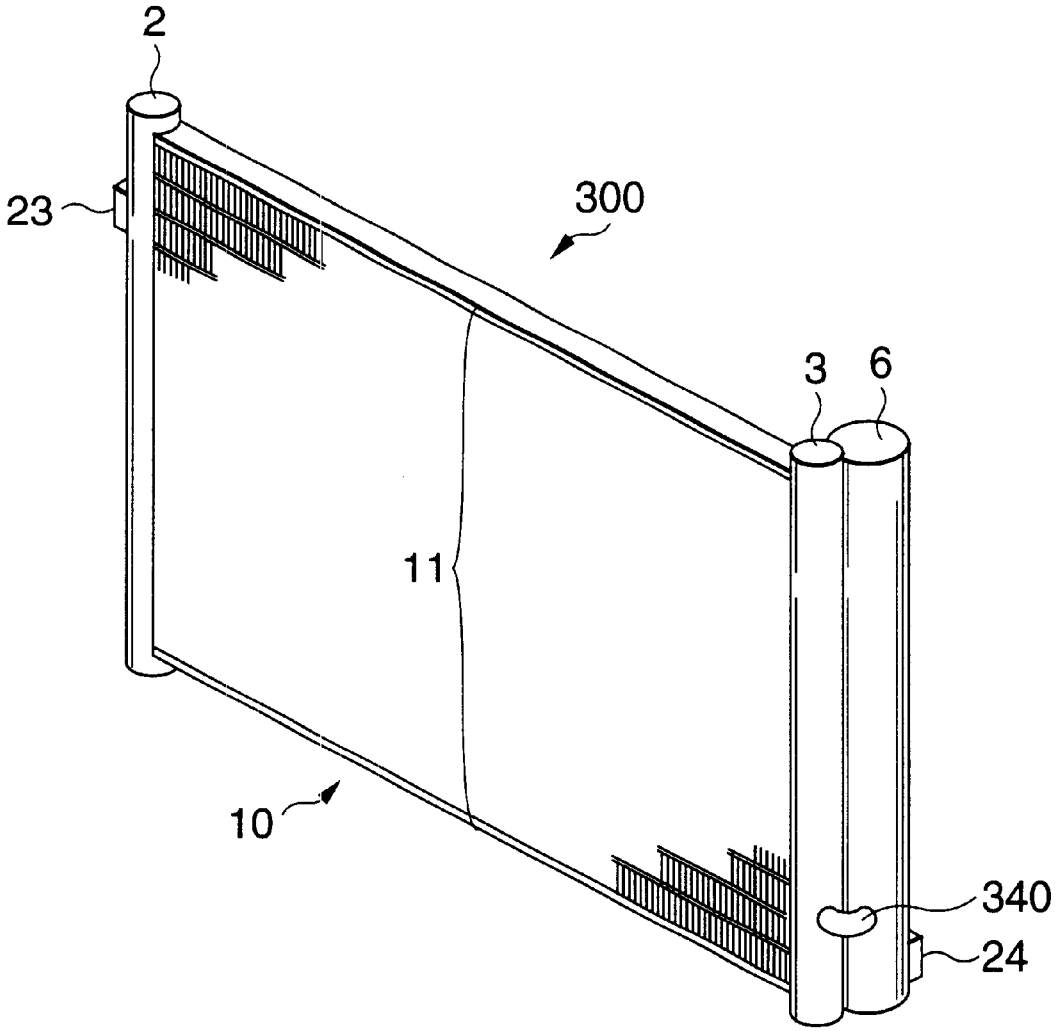
FIG. 10 is a perspective view showing still another embodiment of the present invention.

However, the arrangement (1) according to the present invention may be used in combination with the core section 10 that consists of only the condensing portion 11 as in a condenser 300 shown in FIG. 10, for example. Where the core section 10 consists of only the condensing portion 11, a connection member 340 may be provided with at least one passage, as the refrigerant passage 40, to communicatively connect the header pipe 3 with the reservoir tank 6. In the condenser 300, the outlet portion 24 with an outlet port through which a liquid refrigerant flows out is provided on the reservoir tank 6, not the header pipe 2.

In the condenser 1, 100, 200, the header pipe 2, 3 is parted into the first chamber 21, 31 and the second chamber 22, 32 by the separator 7. If required, as described in JP-A-9-257337, partition walls may be provided in each of the first chambers 21 and 31 of the header pipes 2 and 3 so that each of the first chambers 21 and 31 is divided into small chambers to allow the refrigerant to flow in zig-zag fashion through the condensing portion 11 (For example, the partition walls are arranged such that the refrigerant flows rightward through the heat exchanging tube 4 of the first stage, then leftward through the heat exchanging tube 4 of the second stage, then rightward through the heat exchanging tube 4 of the third stage.). Likewise, partition walls may be provided in each of the second chambers 22 and 32 of the header pipes 2 and 3 so that each of the second chambers 22 and 32 are divided into small chambers to allow the refrigerant to flow in zig-zag fashion through the overcooling portion 12.

Likewise, in the condenser 300, partitioning walls may be provided in each of the header pipes 2 and 3 so that the inside of each of the pipes 2 and 3 are divided into small chambers to allow the refrigerant to flow in a zig-zag fashion in the condensing portion 11.

What is claimed is:

1. A condenser in which a plurality of heat exchanging tubes through which refrigerant flows are disposed between a pair of first and second header pipes and arranged in multiple stages to form a core section for cooling refrigerant through the heat exchanging tubes, a reservoir tank is joined to the first header pipe, and the first header pipe is communicated with the reservoir tank by a refrigerant passage, wherein the first header pipe is communicated with the reservoir tank by a connection member having the substantially horizontally disposed refrigerant passage, the connection member connects a portion of the first header pipe which is out of a joining portion of the header pipe where the header pipe is joined to the reservoir tank to a portion of the reservoir tank which is out of a joining portion of the reservoir tank where the reservoir tank is joined to the header pipe.

2. The condenser in accordance with claim 1, wherein a separator for parting the core section into a condensing portion for condensing and liquefying a gaseous refrigerant and an overcooling portion for overcooling the liquid refrigerant thus formed by the condensing portion is provided within each of the header pipes, each the header pipe is parted, by the separator, into a first chamber communicating with the heat exchanging tubes of the condensing portion and a second chamber communicating with the heat exchanging tubes of the overcooling portion, and the connection member includes, as the refrigerant passage, a first refrigerant passage for communicatively connecting the first chamber in the first header pipe to the reservoir tank, and a second refrigerant passage for communicatively connecting the second chamber in the first header pipe to the reservoir tank.

3. The condenser in accordance with claim 2, wherein the connection member includes a first connection member having the first refrigerant passage and a second connection member that has the second refrigerant passage and that is separated from the first connection member.

4. A condenser in which a plurality of heat exchanging tubes through which refrigerant flows are disposed between a pair of first and second header pipes and arranged in multiple stages to form a core section for cooling refrigerant through the heat exchanging tubes, a reservoir tank is joined to the first header pipe, and the first header pipe is communicated with the reservoir tank by a refrigerant passage, wherein the first header pipe is communicated with the reservoir tank by a connection member having the refrigerant passage, the connection member connects a portion of the first header pipe which is out of a joining portion of the header pipe where the header pipe is joined to the reservoir tank to a portion of the reservoir tank which is out of a joining portion of the reservoir tank where the reservoir tank is joined to the header pipe, wherein an accessory connection port communicated with the refrigerant passage is provided on the connection member so that an accessory part can be attached to the accessory connection port.

5. The condenser in accordance with claim 4, wherein a filter for filtering out dust contained in the refrigerant is inserted into and disposed in the refrigerant passage through the accessory connection port, and the accessory part serving also as a sealing plug of the accessory connection port is attached to the accessory connection port.

6. A condenser for a vehicle air conditioner, comprising:

a pair of first and second header pipes;

a core portion between the header pipes, the core portion having a plurality of heat exchanging tubes each connecting and communicating the first header pipe to the second header pipe;

an accumulator connected to the first header pipe; and at least one connection member connected to the accumulator and the first header pipe, the connection member communicating the accumulator with the first header pipe, wherein the connection member is detachable from the accumulator and the first header pipe in a state that the accumulator remains connected to the first header pipe.

7. The condenser in accordance with claim 6, wherein the connection member has a first side surface conformed in shape to and connected to an outer circumferential surface of the accumulator and a second side surface conformed in shape to and connected to an outer circumferential surface of the first header pipe.

8. The condenser in accordance with claim 6, wherein the connection member is in the form of a pipe connected to an outer circumferential surface of the accumulator and an outer circumferential surface of the first header pipe.

9. A condenser of claim 6, wherein the connection member communicates the accumulator with the first header pipe via a substantially horizontal refrigerant passage.

10. An automobile condenser comprising:

a first header pipe and a second header pipe;

a heat-exchange core including a plurality of parallel heat-exchange tubes between and in fluid communication with said first and the second header pipes;

a tank joined to said first header pipe in a joining area; and a connection member connected to said first header pipe and said tank, said connection member creating a substantially horizontal communication passage between said tank and said first header pipe, wherein said connection member is positioned separated from said joining area.

11. The automobile condenser of claim 10, wherein a surface of said tank is joined directly to a surface of the header pipe in said joining area.

12. The automobile condenser of claim 10, wherein said heat exchange core comprises a condensing portion for condensing and liquefying gaseous refrigerant and an overcooling portion for overcooling liquid refrigerant formed by said condensing portion, wherein said first header pipe is partitioned into first and second chambers corresponding to the condensing and overcooling portions, respectively, and wherein said connection member includes a first communication passage between said tank and said first chamber and a second communication passage between said tank and said second chamber.

13. The automobile condenser of claim 12, wherein said connection member is formed of a unitary structure including both said first and second communication passages.

14. The automobile condenser of claim 12, wherein each of said first and second communication passages is formed by a pipe.

15. The automobile condenser of claim 10, wherein said connection member comprises an accessory connection port that communicates with said communication passage.

16. The automobile condenser of claim 15, further comprising a filter that is disposed in said accessory connection port.

17. The automobile condenser of claim 15, further comprising one of the group of a pressure switch, a pressure sensor and a melting plug operatively connected to said accessory connection port.

18. The automobile condenser of claim 10, wherein said connection member is a pipe.

19. An automobile condenser comprising:

a first header pipe and a second header pipe;

a heat-exchange core including a plurality of parallel heat-exchange tubes between and in fluid communication with said first and the second header pipes;

a tank joined to said first header pipe in a joining area wherein an outer surface of said tank is directly joined to an outer surface of said first header pipe in said joining area; and a connection member connected to said first header pipe and said tank, said connection member creating a communication passage between said tank and said first header pipe, wherein said connection member is positioned separated from said joining area.

20. The automobile condenser of claim 19, wherein said heat exchange core comprises a condensing portion for condensing and liquefying gaseous refrigerant and an overcooling portion for overcooling liquid refrigerant formed by said condensing portion, wherein said first header pipe is partitioned into first and second chambers corresponding to the condensing and overcooling portions, respectively, and wherein said connection member includes a first communication passage between said tank and said first chamber and a second communication passage between said tank and said second chamber.

21. The automobile condenser of claim 20, wherein said connection member is formed of a unitary structure including both said first and second communication passages.

22. The automobile condenser of claim 20, wherein each of said first and second communication passages is formed by a pipe.

23. The automobile condenser of claim 19, wherein said connection member comprises an accessory connection port that communicates with said communication passage.

24. The automobile condenser of claim 23, further comprising a filter that is disposed in said accessory connection port.

25. The automobile condenser of claim 23, further comprising one of the group of a pressure switch, a pressure sensor and a melting plug operatively connected to said accessory connection port.

26. The automobile condenser of claim 19, wherein said connection member is a pipe.

27. The automobile condenser of claim 19, wherein said joining area comprises an elongated contact area extending along respective lengths of said first header pipe and said tank.

* * * * *